US006799332B2

(12) United States Patent
Hatton

(10) Patent No.: US 6,799,332 B2
(45) Date of Patent: Oct. 5, 2004

(54) TWO-PIECE PATIENT EXAMINATION GARMENT

(76) Inventor: Richard L. Hatton, 2037 E. Grand River Ave., Okemos, MI (US) 48864

( * ) Notice: Subject to any disclaimer, the term of this patent is extended or adjusted under 35 U.S.C. 154(b) by 0 days.

(21) Appl. No.: 10/200,784

(22) Filed: Jul. 23, 2002

(65) Prior Publication Data

US 2003/0051287 A1 Mar. 20, 2003

Related U.S. Application Data

(63) Continuation-in-part of application No. 09/697,215, filed on Oct. 26, 2000, now Pat. No. 6,460,188.

(60) Provisional application No. 60/318,353, filed on Sep. 10, 2001, provisional application No. 60/307,286, filed on Jul. 23, 2001, and provisional application No. 60/162,689, filed on Nov. 1, 1999.

(51) Int. Cl.[7] ..... A41D 13/00

(52) U.S. Cl. ..... 2/114; 2/69

(58) Field of Search ..... 2/114, 88, 109.69, 2/69.5, 71, 104–106, 74, 80, 83, 75, 238, 93–95, 85, 79, 227, 228, 78.1–78.3, 73, 242, 113, 115, 50, 51, 46, 400, 403, 405, 406, 408, DIG. 1; 128/849, 850, 853–855, 869, 872–874; 604/385–396; 450/99–105, 120, 125–128, 140, 148, 149

(56) References Cited

U.S. PATENT DOCUMENTS 512,229 A * 1/1894 Shelley ..... 2/78.1
1,512,171 A * 10/1924 Homling ..... 2/78.1
1,704,887 A * 3/1929 Flavell et al. ..... 2/78.1
2,010,483 A * 8/1935 Goodman ..... 2/78.1
2,802,465 A * 8/1957 Brown ..... 2/400
4,446,575 A * 5/1984 Davis ..... 2/400
4,930,161 A * 6/1990 Cohen ..... 2/114
5,341,515 A * 8/1994 Cohen ..... 2/400
5,802,611 A * 9/1998 McKenzie et al. ..... 2/69
5,896,581 A * 4/1999 Wong ..... 2/78.2
5,930,838 A * 8/1999 Carter-Scott-Pomije ..... 2/79
6,102,899 A * 8/2000 Yimin ..... 604/385.01
6,460,188 B1 * 10/2002 Hatton ..... 2/114

* cited by examiner

*Primary Examiner*—Gloria Hale
(74) *Attorney, Agent, or Firm*—MacMillan, Sobanski & Todd, LLC

(57) ABSTRACT

An examination garment to be worn by a patient during a physical examination includes an upper garment and a lower garment. The upper garment includes a first front panel, a second front panel, a rear panel having an opening for examination of a patient's spine, and fasteners for removably connecting various points of the front and rear panels. The lower garment includes a front panel with a movable front center panel and leg members, a rear panel with a movable rear center panel, leg fasteners for removably connecting the leg members, and panel fasteners for removably connecting rear panel and rear center panel.

11 Claims, 13 Drawing Sheets

TWO-PIECE PATIENT EXAMINATION GARMENT

CROSS-REFERENCE TO RELATED APPLICATION

This application is a continuation-in-part of the U.S. patent application Ser. No. 09/697,215 filed Oct. 26, 2000. issued on Oct. 8, 2002 as U.S. Pat. No. 6,460,188, which claims the benefit of U.S. provisional patent application serial No. 60/162,689 filed Nov. 1, 1999.

This application claims the benefit of U.S. provisional patent application serial No. 60/307,286 filed Jul. 23, 2001 and the benefit of U.S. provisional patent application serial No. 60/318,353 filed Sep. 10, 2001.

BACKGROUND OF THE INVENTION

This invention relates in general to garments worn by patients during physical examinations conducted by physicians.

When a physician conducts a physical examination of a patient, it is desirable to balance the physician's need for access and the patient's desire for coverage. In general, an examination can be best performed when a patient is comfortable with the procedure. To reduce embarrassment and maintain body temperature, various garments have been developed. These garments can be reusable or disposable, and can be formed from a variety of materials. Furthermore, various garments have been developed for specific areas of a body.

SUMMARY OF THE INVENTION

This invention includes a garment worn by a patient during a physical examination. The garment provides accessibility of various parts of the body while providing a satisfying amount of coverage for a patient. The garment includes an upper garment covering portions of the upper torso and a lower garment covering the pelvic region. The garment can be formed from any desired material as a disposable or reusable garment.

In a preferred embodiment, an examination garment to be worn by a patient during a physical examination includes an upper garment and a lower garment. The upper garment includes a first front panel, a second front panel, a rear panel having an opening for examination of a patient's spine, and fasteners for removably connecting various points of the front and rear panels. The lower garment includes a waistband, a first front panel overlapping at least a portion of a second front panel, a front central panel overlapped by the first and second front panels, a rear outer panel, a rear inner panel having an opening overlapped by the rear outer panel, and fasteners for removably connecting the front and rear panels.

Various objects and advantages of this invention will become apparent to those skilled in the art from the following detailed description of the preferred embodiment, when read in light of the accompanying drawings.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 2:
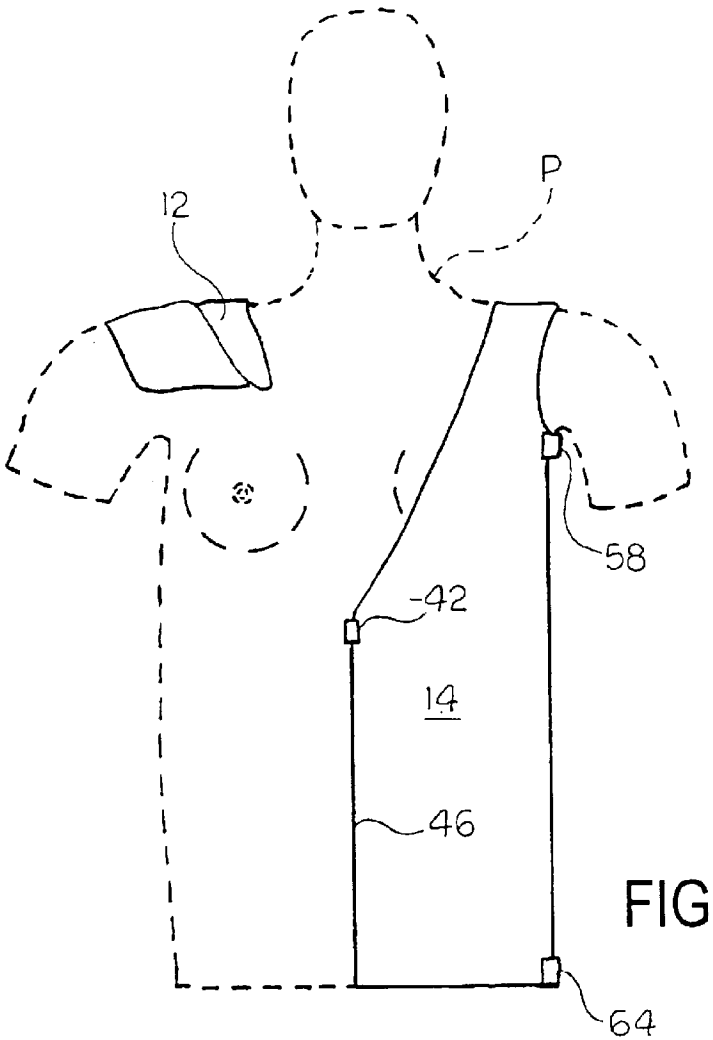
FIG. 2 is a front view of the upper garment of FIG. 1 worn by a patient illustrated in phantom lines wherein the first front panel has been folded upwardly for a breast examination.
Figure 1:
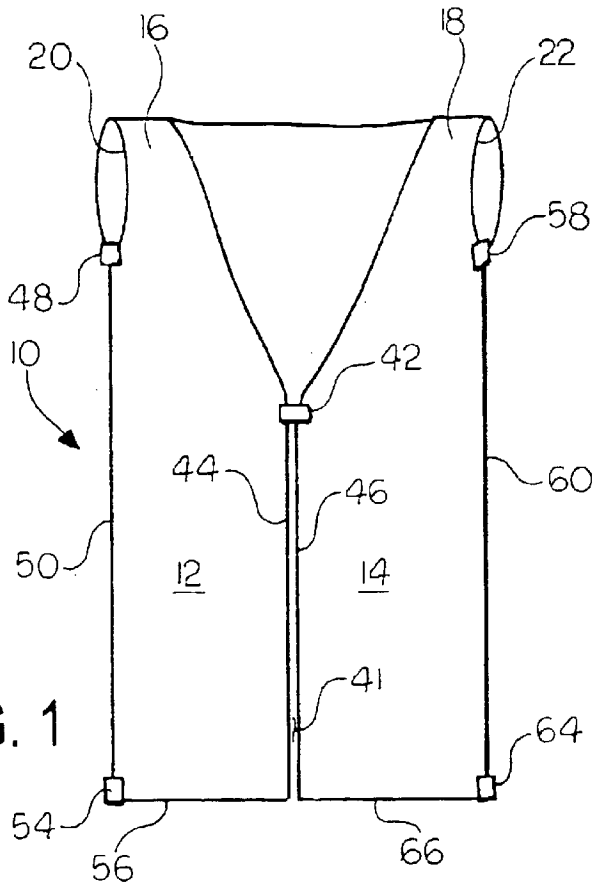
FIG. 1 is a front view of an upper garment according to this invention illustrating first and second front panels.

A two piece patient garment according to this invention includes an upper garment indicated generally at 10 in FIGS. 1, 2, 3, 4, and 11 and a lower garment indicated generally at 100 in FIGS. 5, 6, 7, 8, and 9.

The upper garment 10 is fitted about the upper torso of a patient and extends generally to the lower hip and buttock level of a patient. The upper garment 10 is designed to permit a physician to conduct a clinical examination of a patient from the waist to the head with minimal manipulation of the garment 10 while providing a satisfying amount of coverage for the patient.

The upper garment 10 includes a first front panel 12 and a second front panel 14. Upper sections 16 and 18 of the panels 12 and 14, respectively, are received over a shoulder of a patient. A patient's neck is received between upper sections 16 and 18. Openings 20 and 22 are sized to permit examination of the shoulder and arm pit areas without removal of the upper garment 10.

The upper garment 10 also includes a rear panel 23 divided into a first rear panel 24 and a second rear panel 26. The rear panels 24 and 26 include upper sections 28 and 30, respectively that are joined with upper sections 16 and 18. In one preferred embodiment, upper section 28 is connected to upper section 18, and upper section 30 is connected to upper section 16. In other embodiments, the upper sections can be joined as desired.

The rear panels 24 and 26 include cutouts 32 and 34 that form an orthopedically designed slot 36 to expose a patient's spine. The slot 36 can be formed with any configuration. An opening for examination of another desired area can be formed in lieu of or in addition to the slot 36. A slit 40 can be provided between lower portions of the panels 24 and 26 to permit one or both panels to be folded for examination.

Various fasteners are used to join the panels 12, 14, 24, and 26 together. Preferably, metal fasteners are used for cloth garments and crimps are used for paper garments. However, other types of fasteners can be used.

Fastener 42 joins an inner edge 44 of the first front panel 12 with an inner edge 46 of the second front panel 14 at a level close to the breastbone. Fastener 48 is provided to join an outer edge 50 of the first front panel 12 with an outer edge 52 of the first rear panel 24 beneath cutout 20. Fastener 54 is provided at a bottom edge 56 of the first front panel 12 to join outer edges 50 and 52.

Fastener 58 is provided to join an outer edge 60 of the second front panel 14 with an outer edge 62 of the second rear panel 26 beneath cutout 22. Fastener 64 is provided at a bottom edge 66 of the second front panel 14 to join outer edges 60 and 62. Fastener 69 can be provided at or near a lower end of the slot 36.

Front panels 12 and 14, rear panels 24 and 26, and openings 20 and 22 are sized so that they the panels meet at the lowest point of the armpits and are connected by fasteners 48 and 58. The fasteners 48 and 58 stabilize the upper garment 10 so that it will not slip or fall off a patient.

Figure 4:
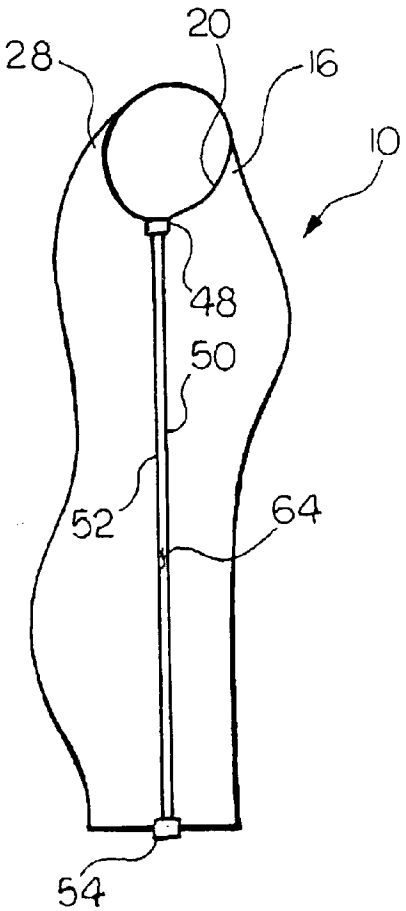
FIG. 4 is a side view of the upper garment illustrated in FIGS. 1, 2, and 3.
Figure 3:
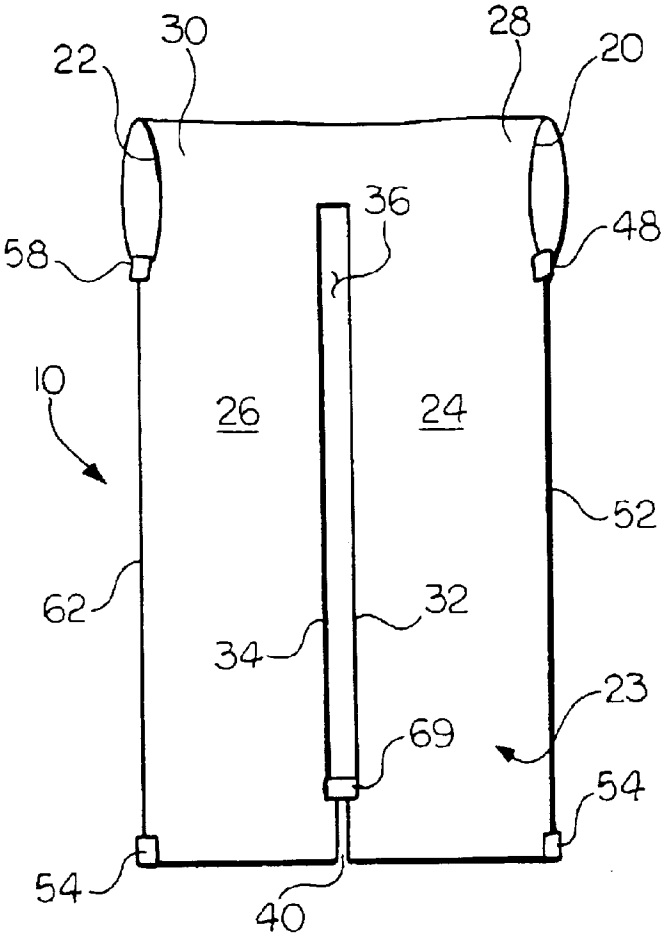
FIG. 3 is a rear view of the upper garment illustrated in FIGS. 1 and 2.

As shown in FIG. 4, a slit 64 is formed along a patient's side between the outer edges 50 and 52 when fasteners 48 and 50 at the top of edges 50 and 52 are mated. Slit 64 permits access for an examination without disturbing the remainder of the upper garment 10.

Properly selected fasteners on the upper garment 10 can be released to permit a panel to be folded for examination. For example, in FIG. 2 the first front panel 12 is shown folded upwardly to permit examination of a breast of a patient P. The remainder of the upper garment 10 does not have to be disturbed, thus providing a patient with coverage. The first front panel 12 can be draped over a patient's shoulder.

In another embodiment, the upper garment 10 can be formed from a single piece of material having a front panel, a rear panel, and cutouts for the neck and arms. A slot like slot 36 can be cut from the rear panel. The slot 36 can have a predetermined width extending equal distances from a midline. Also, a slit like slit 40 can be provided in the rear panel. A slit like slit 41 can be provided in the front panel.

Any number of fasteners can be used with the panels 12, 14, 24, and 26. More fasteners, less fasteners, and the number of fasteners illustrated in FIGS. 1–4 are within the scope of the present invention.

Figure 5:
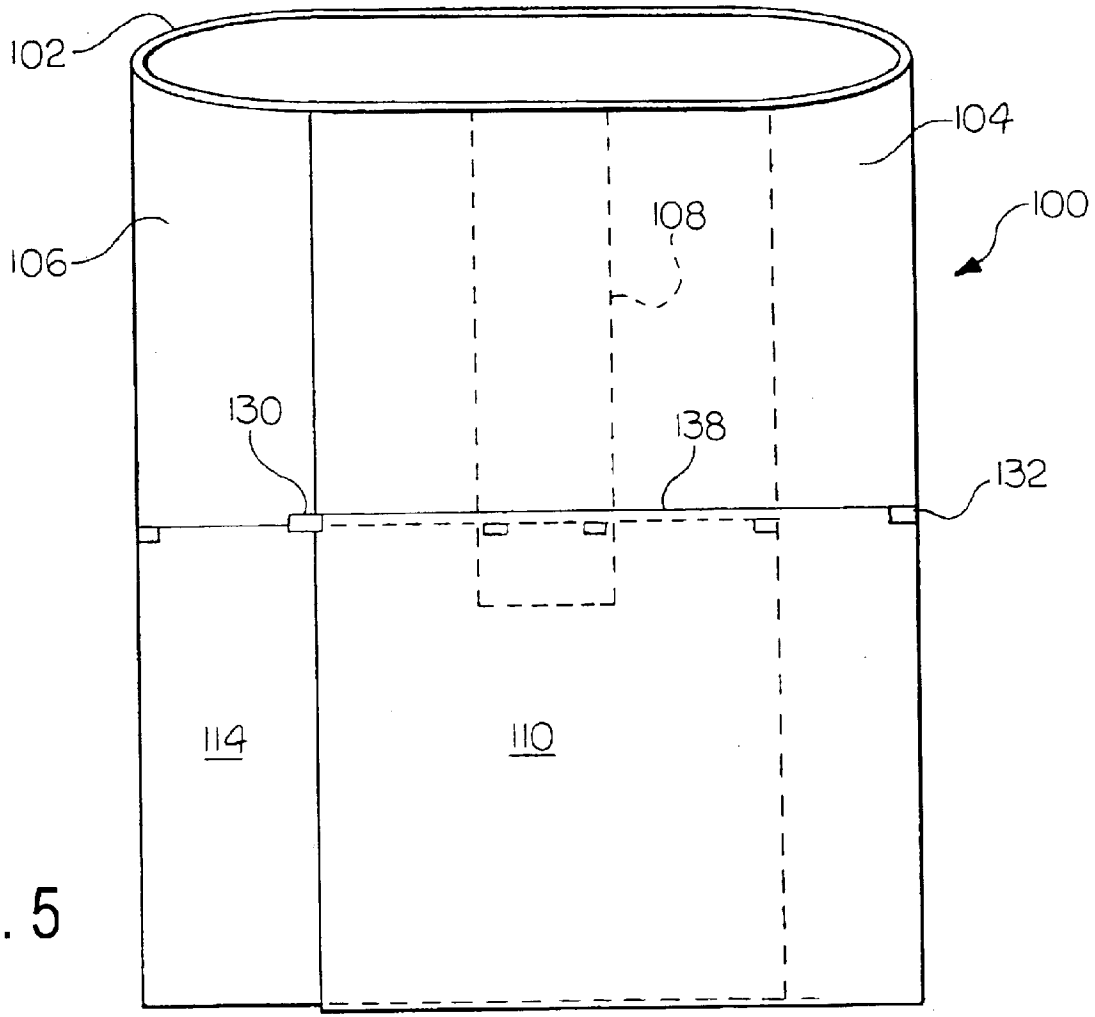
FIG. 5 is a front view of a lower garment according to this invention illustrating first and second overlapping front panels.
Figure 6:
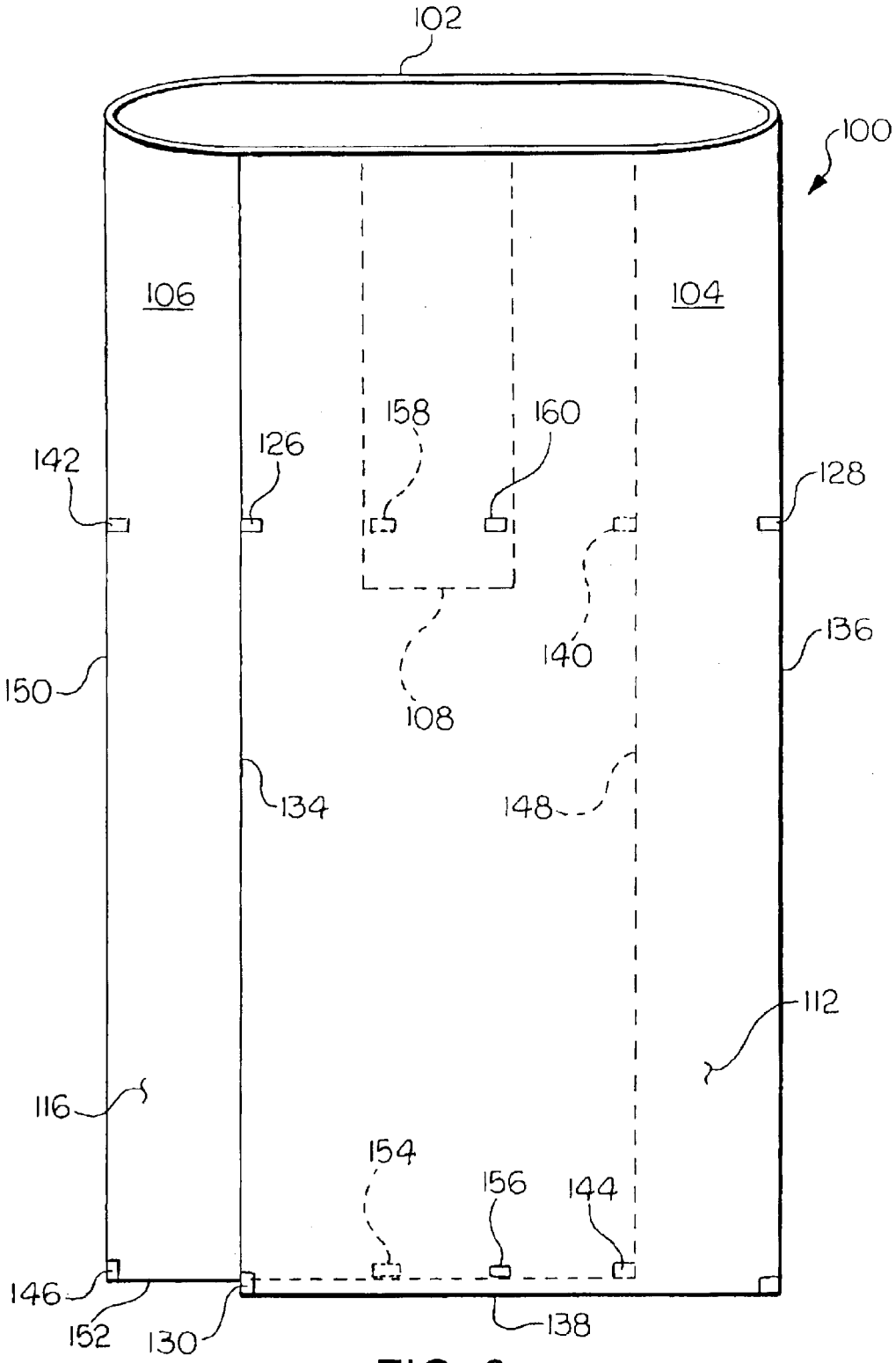
FIG. 6 is a front view of the lower garment of FIG. 5 wherein the front panels have been extended to form leggings.
Figure 7:
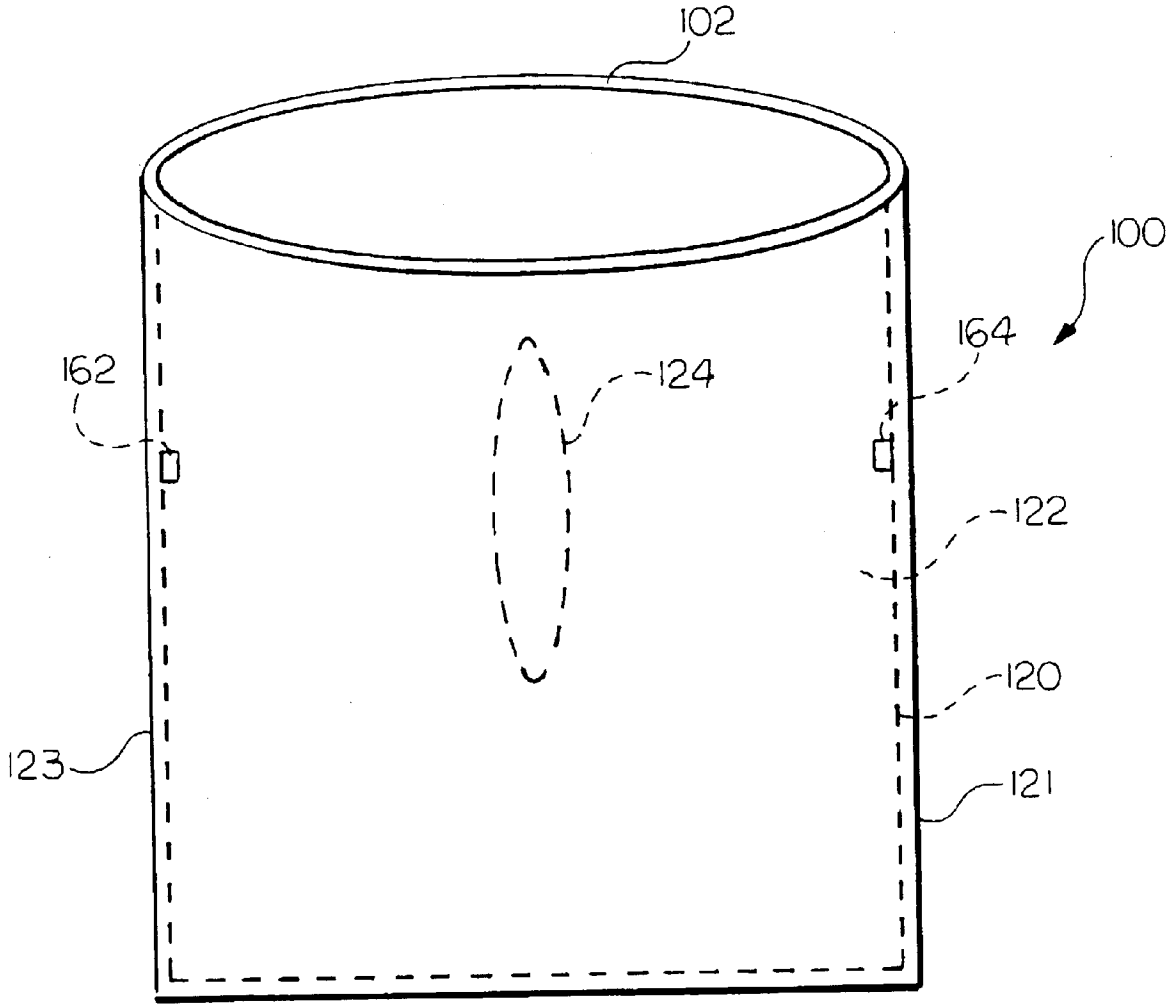
FIG. 7 is a rear view of the lower garment illustrated in FIG. 5.
Figure 8:
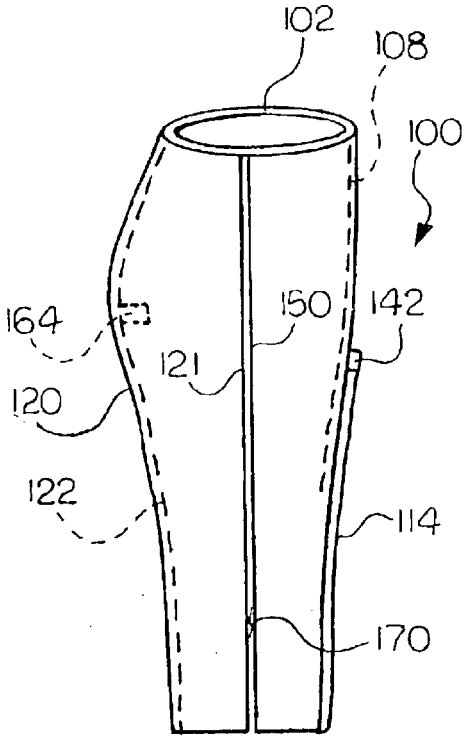
FIG. 8 is a side view of the lower garment illustrated in FIG. 5.
Figure 9:
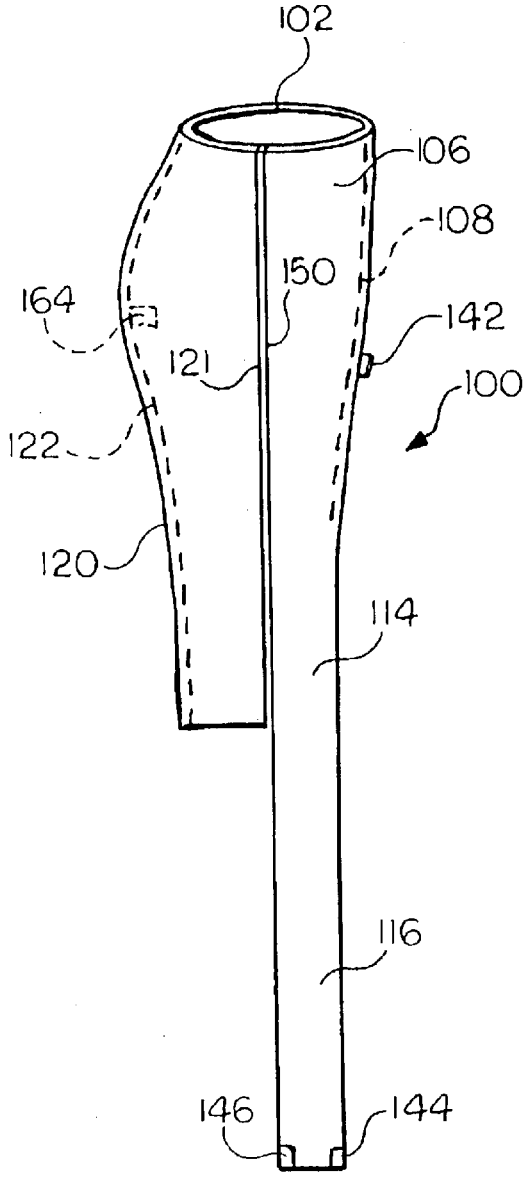
FIG. 9 is a side view of the lower garment illustrated in FIG. 6.

A lower garment for a patient is indicated generally at 100 in FIGS. 5, 6, 7, 8 and 9. In a folded position, as shown in FIGS. 5, 7, and 8, the lower garment 100 is fitted about the waist level of a patient and extends to approximately knee level, resembling a skirt. In the extended position, as shown in FIGS. 6 and 9, two anterior panels can be extended to the ankle area. The lower garment 100 is designed to permit a physician to conduct a clinical examination of a patient's abdomen, genitalia, anal and rectal areas, and lower extremities while provided a satisfying amount of patient coverage.

The lower garment 100 includes a waistband 102, preferably formed from an elastic material that supports the lower garment 100 at approximately waist level. A first front panel 104 and a second front panel 106 are attached to the waistband 102 and partially overlap one another. A central, inner front panel 108 is also attached to the waistband 102 and is overlapped by panels 104 and 106. The central panel 108 is sized to cover a patient's external genitalia. Each of panels 104 and 106 can be independently folded on the abdomen for an examination of one or both lower extremities without disturbing the central panel 108.

In FIG. 5, the panels 104 and 106 are illustrated in a stored or folded position, with lower portions 110 and 114 respectively folded up, so that coverage extends to approximately the level of the knees. In FIGS. 6 and 9, panels 104 and 106 can be folded down as shown to provide leggings 112 and 116, respectively.

As shown in FIGS. 7, 8, and 9, the lower garment 100 also includes an outer rear panel 120 and an inner rear panel 122. Preferably, the panels 120 and 122 are attached to the waistband 102. The outer rear panel 120 overlaps the inner rear panel 122. The inner rear panel 122 includes an opening 124 sized to permit anal and rectal examinations. The outer rear panel 120 includes side edges 121 and 123.

As illustrated best in FIG. 6, fasteners 126, 128, 130, 132, 156 and 160 are provided on the first front panel 104. Fastener 126 is provided along an inner edge 134 at a central portion of its length. Fastener 128 is provided along an outer edge 136 at a central portion of its length. Fastener 130 is provided along the inner edge 134 at a bottom edge 138 of the panel 104. Fastener 132 is provided along the outer edge 136 at the bottom edge 138. Fastener 156 is provided approximately midway between fasteners 130 and 132. Fastener 160 is provided approximately midway between fasteners 126 and 128.

Fasteners 140, 142, 144, 146, 154, and 158 are provided on the second front panel 106. Fastener 140 is provided along an inner edge 148 at a central portion of its length. Fastener 142 is provided along an outer edge 150 at a central portion of its length. Fastener 144 is provided along the inner edge 148 at a bottom edge 152 of the panel 106. Fastener 146 is provided along the outer edge 150 at the bottom edge 152. Fastener 158 is provided approximately midway between fasteners 140 and 142. Fastener 154 is provided approximately midway between fasteners 144 and 146.

In the folded position (see FIG. 5), fastener 130 is mated with fastener 126, fastener 132 is mated with fastener 128, and fastener 156 is mated with fastener 160 to retain the legging 112. Fastener 144 is mated with fastener 140, fastener 146 is mated with fastener 142, and fastener 154 is mated with fastener 158 to retain the legging 116.

In the extended (unfolded) position (see FIGS. 6 and 9), fasteners 130 and 132 can be mated to wrap the legging 112 about a patient's leg. Fasteners 144 and 146 can be mated to wrap the legging 116 about a patient's leg.

As illustrated in FIG. 7, the rear inner panel 122 can include fasteners 162 and 164 provided at its outer edges. Fastener 162 can be mated to fastener 128 on panel 104 and fastener 164 can be mated to fastener 142 on panel 106 to stabilize the rear inner panel 122, particularly when a patient is lying on a side for an examination.

As illustrated in FIGS. 8 and 9, a slit 170 is provided between outer edge 150 and side edge 121. The slit 170 permits access to the hip region without disturbing the remainder of the lower garment 100. A similar slit (not illustrated) is provided on the opposite side of the lower garment.

More, less, or the number of fasteners illustrated in FIGS. 5–9 can be provided on the lower garment 100.

Figure 10:
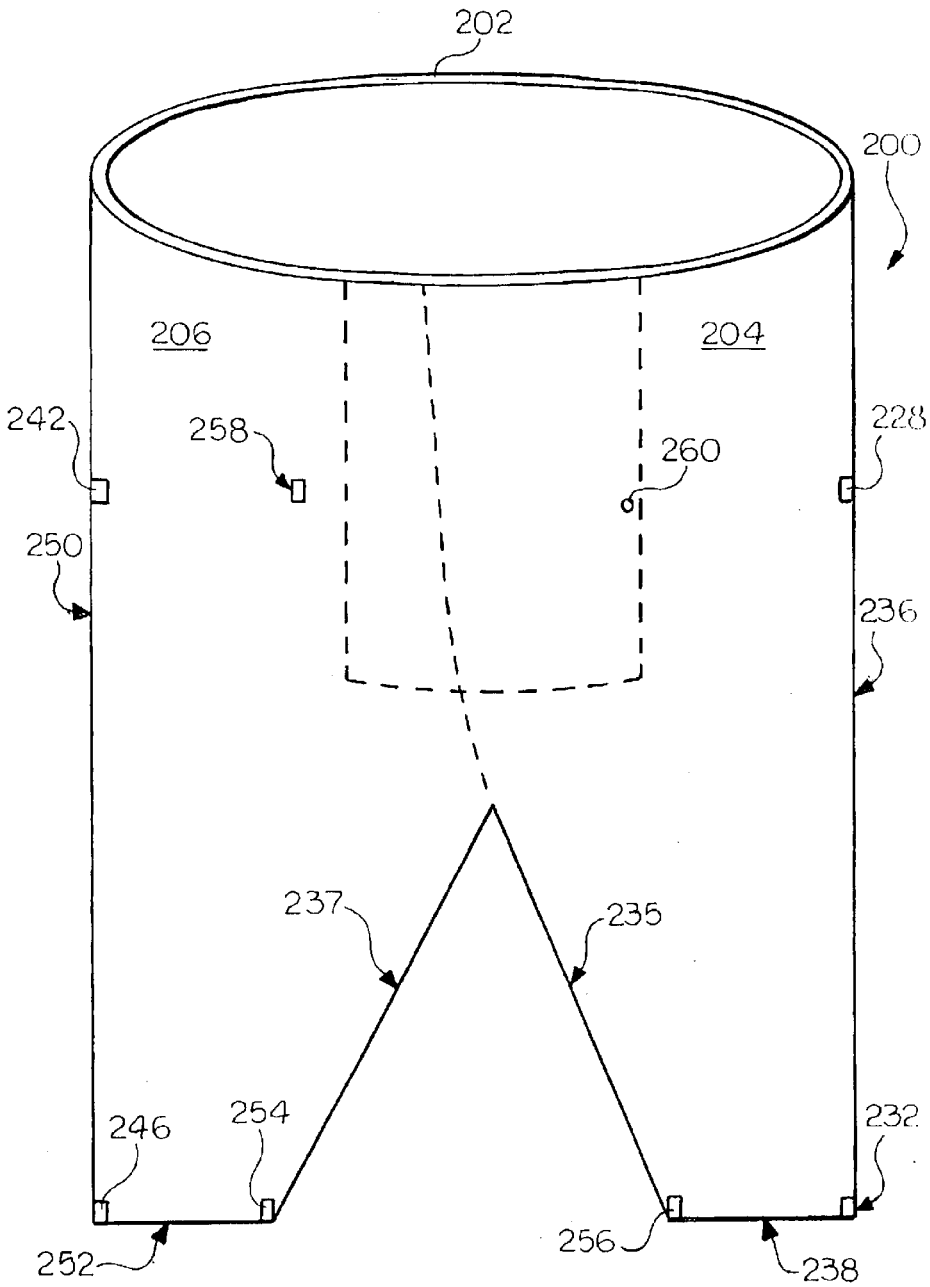
FIG. 10 is a front view of a second embodiment of a lower garment according to this invention wherein the front panels have been extended to form leggings.
Figure 11:
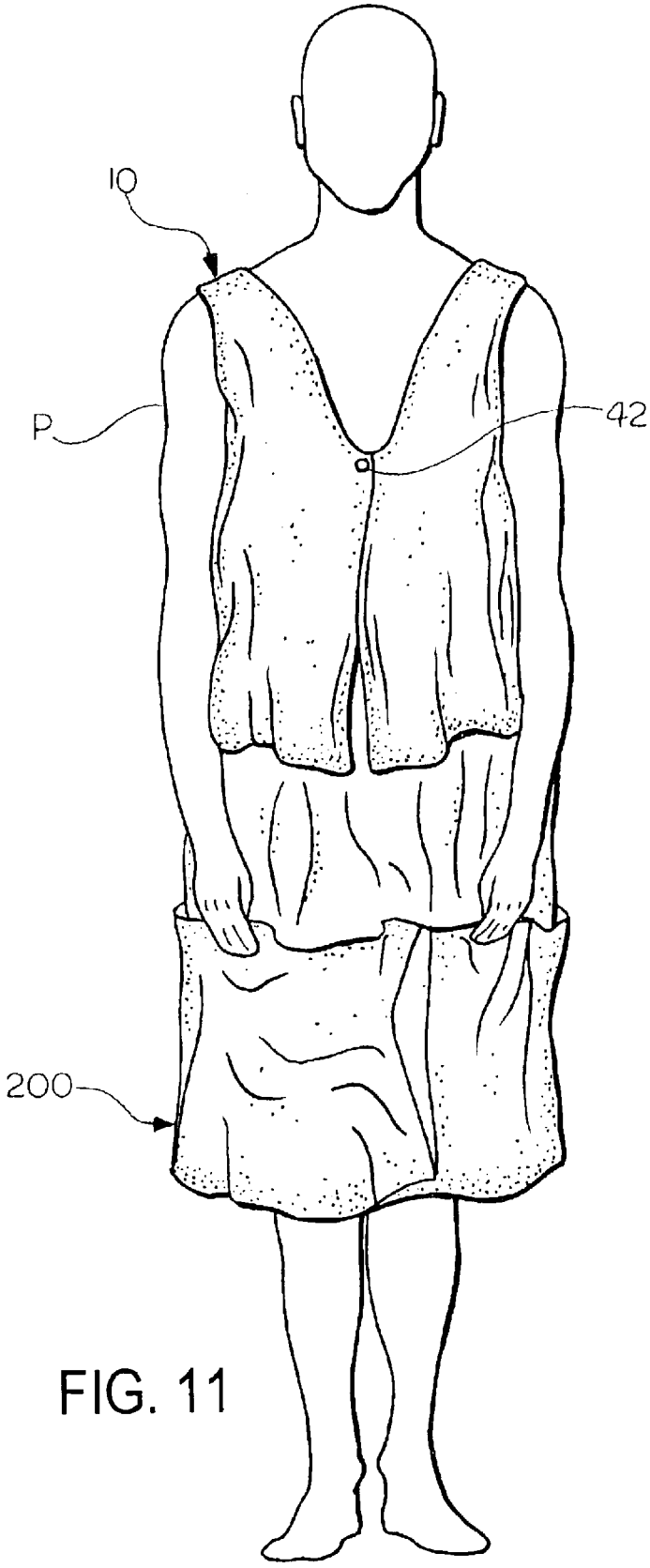
FIG. 11 is a front view of a patient wearing the upper garment of FIGS. 1–4 and the lower garment of FIG. 10.
Figure 12:
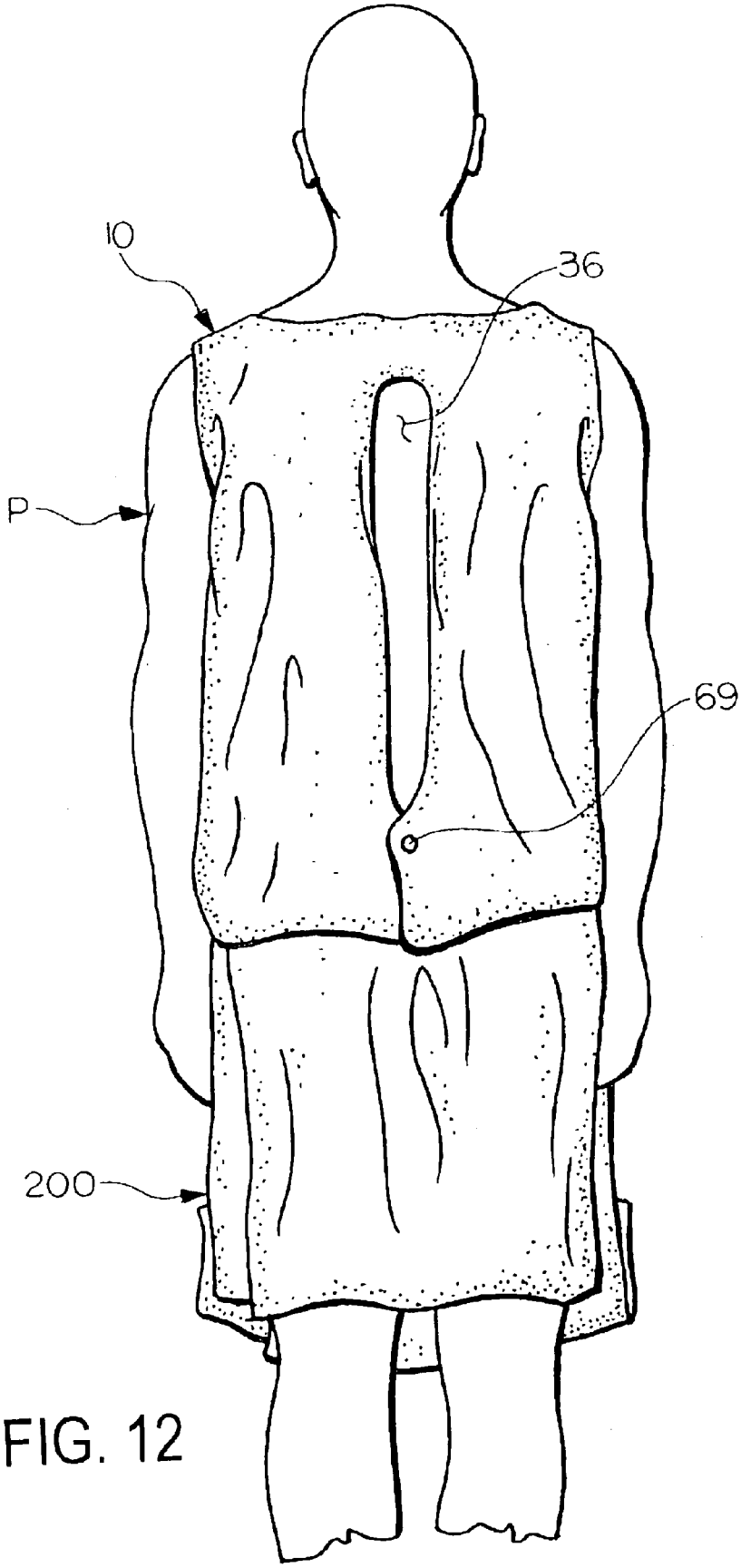
FIG. 12 is a rear view of the patient of FIG. 11 wearing the upper garment of FIGS. 1–4 and the lower garment of FIG. 10.

A second embodiment of a lower garment for a patient is indicated generally at 200 in FIGS. 10 and 12. In a folded position, not shown, the lower garment 200 is fitted about the waist level of a patient and extends to approximately knee level, resembling a skirt. In the extended or unfolded position, as shown in FIG. 10, two anterior panels can be extended to the ankle area. The lower garment 200 is designed to permit a physician to conduct a clinical examination of a patient's abdomen, genitalia, anal and rectal areas, and lower extremities while provided a satisfying amount of patient coverage.

The lower garment 200 includes a waistband 202, preferably formed from an elastic material that supports the lower garment 200 at approximately waist level. A first front panel 204 and a second front panel 206 are attached to the waistband 202 and partially overlap one another. A central, inner front panel 208 is also attached to the waistband 202 and is overlapped by panels 204 and 206. The central panel 208 is sized to cover a patient's external genitalia. Each of panels 204 and 206 can be independently folded on the abdomen for an examination of one or both lower extremities without disturbing the central panel 208.

The panels 204 and 206 can be arranged in a stored or folded position so that coverage extends to approximately the level of the knees, similar to the arrangement in FIG. 5. In FIG. 10, panels 204 and 206 can be folded down as shown to provide leggings 212 and 216, respectively, similar to the arrangement in FIG. 6. Preferably, the leggings 212 and 216 (approximately the lower halves of panels 204 and 206) are narrowed from the approximately upper halves or portions of panels 204 and 206, respectively. For example, the width of the leggings 212 and 216 can be reduced to approximately twelve inches at the approximate ankle level, significantly less than the upper portions of the panels 204 and 206.

As illustrated in FIG. 10, fasteners 228, 232, 256 and 260 are provided on the first front panel 204. Fastener 228 is provided along an outer edge 236 at a central portion of its length. Fastener 232 is provided along the outer edge 236 at a bottom edge 238. Fastener 256 is provided along an inner edge 235 at the bottom edge 238. Fastener 260 is provided approximately midway the width of the upper portion of panel 204 and approximately aligned with fastener 228.

Fasteners 242, 246, 254, and 258 are provided on the second front panel 206. Fastener 242 is provided along an outer edge 250 at a central portion of its length. Fastener 246 is provided along the outer edge 250 at a bottom edge 252. Fastener 254 is provided along an inner edge 237 at the bottom edge 252. Fastener 258 is provided approximately midway the width of the upper portion of panel 206 and approximately aligned with fastener 242.

In the folded position (not shown), fastener 232 is mated with fastener 228, and fastener 256 is mated with fastener 260 to retain the legging 212. Fastener 246 is mated with fastener 242, and fastener 254 is mated with fastener 258 to retain the legging 216.

In the extended (unfolded) position (FIG. 10), fasteners 256 and 232 can be mated to wrap the legging 212 about a patient's leg. Fasteners 254 and 246 can be mated to wrap the legging 116 about a patient's leg.

Figure 13:
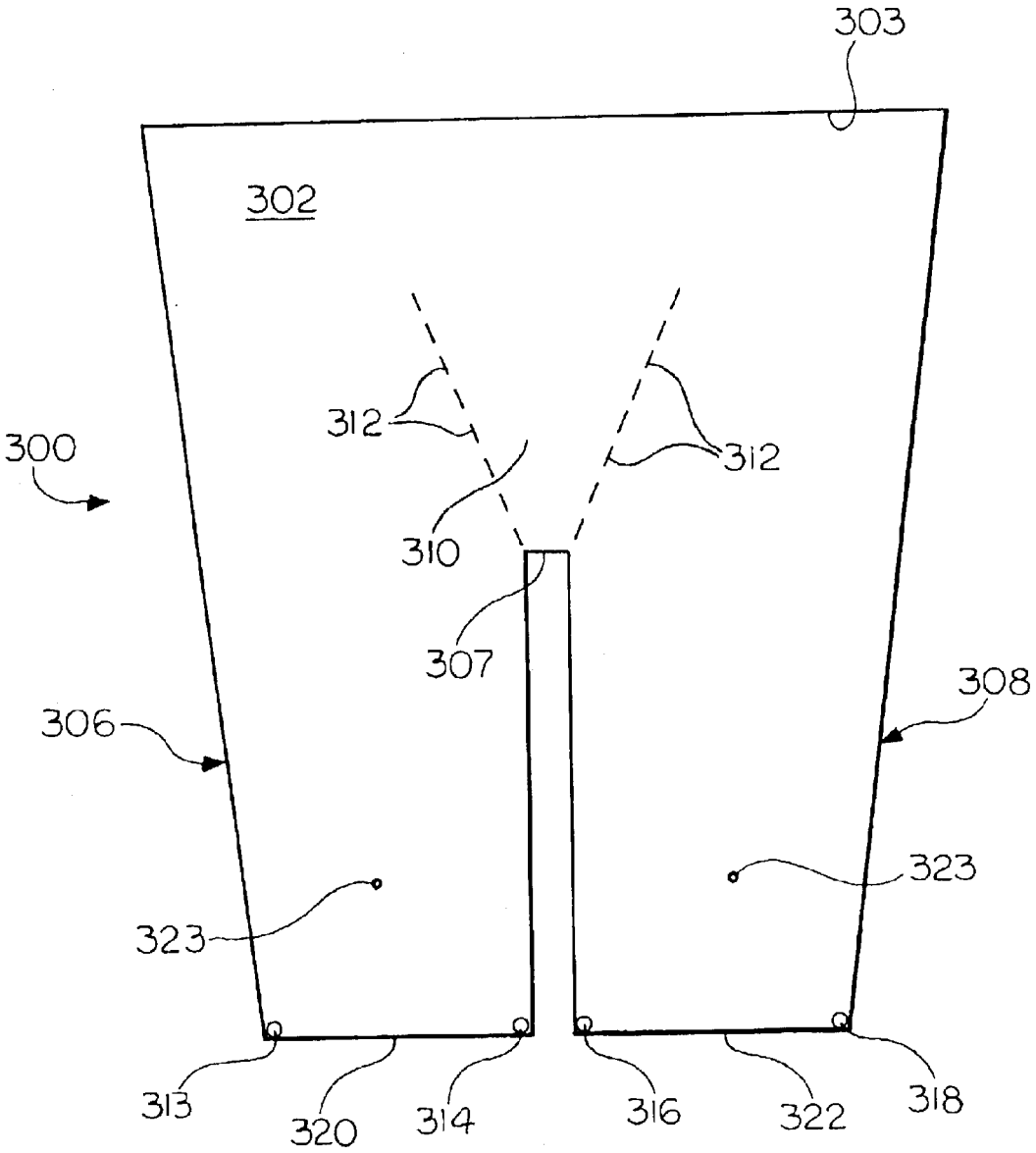
FIG. 13 is a front view of an alternative embodiment of a lower garment in accordance with the present invention.
Figure 14:
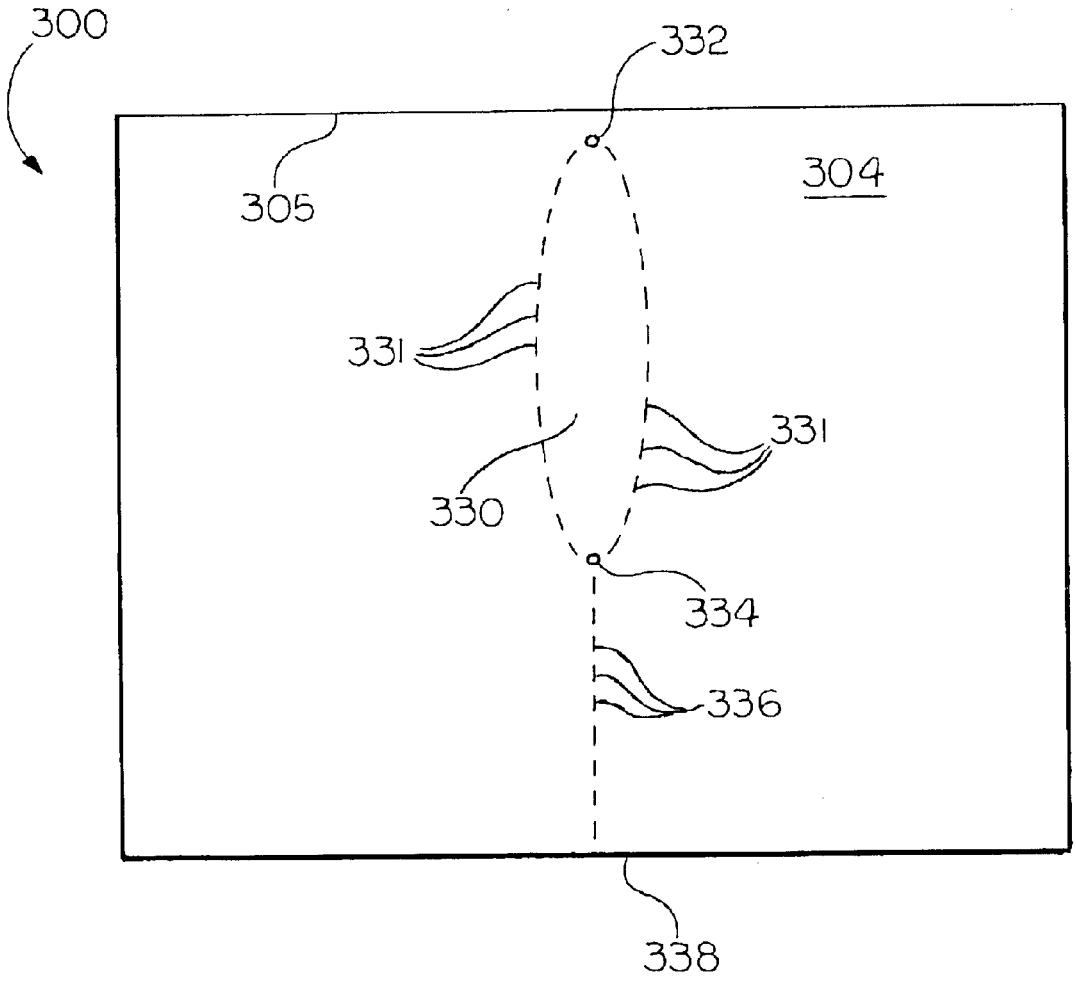
FIG. 14 is a rear view of the lower garment illustrated in FIG. 13.

Another embodiment of a lower garment for a patient is indicated generally at 300 in FIGS. 13 and 14. The lower garment 300 is designed to permit a physician to conduct a clinical examination of a patient's genitalia, anal and rectal areas, and lower extremities while provided a satisfying amount of patient coverage.

Figure 15:
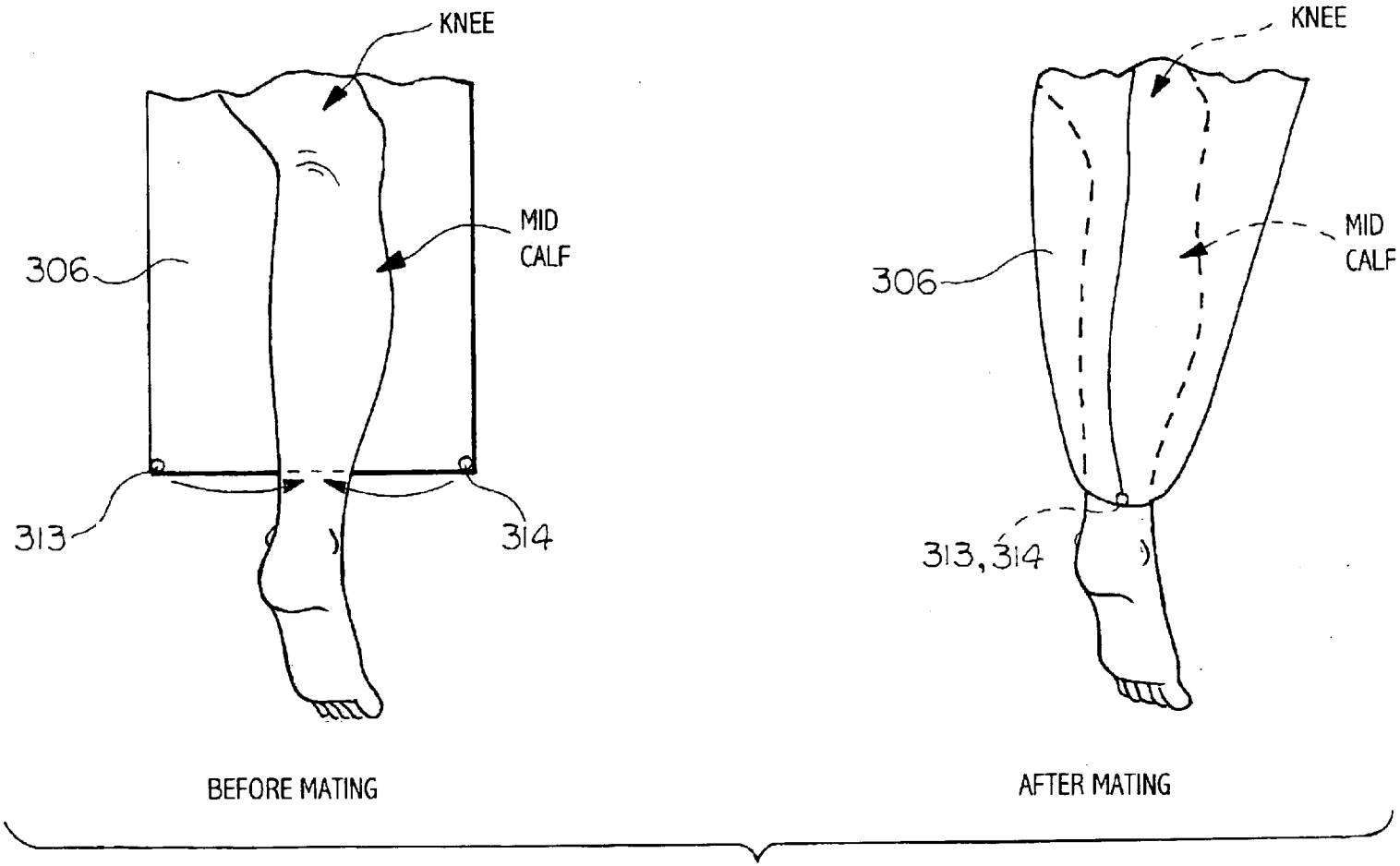
FIG. 15 is front view of the right leg member shown in FIG. 13 before and after mating of the fasteners.

The lower garment 300 is preferably formed from a single layer of material and includes a front panel 302 attached to a rear panel 304 at a top seam 303. A first leg member 306 and a second leg member 308 extend downwardly from a bottom seam or edge 307 of the front panel 302. A front central panel 310 is formed from a plurality of perforations 312 in the front panel and the bottom seam 307. The front central panel 310 is sized to cover a patient's external genitalia. The front central panel 310 is adapted to be torn along the perforations 312 in order to be folded, or reflected, upwardly on a patient's abdomen (not shown) at the time of the patient's examination. Alternatively, the front central panel 310 is completely removed from the front panel 302 at the time of the patient's examination. A fastener 313 and a fastener 314 are provided along a bottom edge 320 of the first leg member 306. A fastener 316 and a fastener 318 are provided along a bottom edge 322 of the second leg member 308. The leg fasteners 313, 314, 316, and 318 are male and female pairs to mate and permit the leg members 306 and 308 to encircle the calf to form a short legging during the examination as shown in FIG. 15. A knee level point 323 is shown on the first leg member 306 and the second leg member 308. The bottom edge 320 and the bottom edge 322 preferably extend below the knee levels 323.

The rear panel 304 has a top seam 305. The top seam 305 and the top seam 303 of the front panel 302 can be attached to a waistband such as the waistband 202 shown in FIG. 10. A rear central panel 330 is formed from a plurality of perforations 331 in the rear panel 304. The rear central panel 330 is sized to permit an examination of a patient's anal and rectal areas. A panel fastener 332 is attached at a top portion of the rear central panel 330 and a panel fastener 334 is attached at a bottom portion of the rear central panel 330. Typically, prior to use, the rear central panel 330 is substantially separated from the rear panel 304 along the perforations with only a top end remaining attached. In a closed position, prior to a patient's examination, the fastener 334 is attached to a fastener (not shown) on the rear panel 304 adjacent the bottom portion of the rear central panel 330 to fully extend the rear central panel 330 and provide a satisfying amount of patient coverage. In an open position, during a patient's examination, the fastener 334 is attached to the fastener 332, allowing the rear central panel 330 to reflect upwardly. After the examination, the fastener 334 is detached from the fastener 332 and reattached to the fastener at the bottom portion of the rear central panel. A plurality of perforations 336 in the rear panel 304 extend from the lower end of the rear central panel 330 to a bottom edge 338 to permit separation and allow easier manipulation of examination instruments (not shown) during the patient's examination. The bottom edge 338 of the rear panel 304 is preferably at or slightly below a knee level of the patient (not shown).

As an alternative, in a closed position, prior to a patient's examination, the fastener 332 is attached to a fastener (not shown) at the top portion of the rear central panel 330 to fully extend the rear central panel 330 and provide a satisfying amount of patient coverage. In an open position, during a patient's examination, the fastener 332 is attached to the fastener 334, allowing the rear central panel 330 to reflect upwardly. After the examination, the fastener 332 is detached from the fastener 334 and reattached to the fastener at the top portion of the rear central panel.

Figure 16:
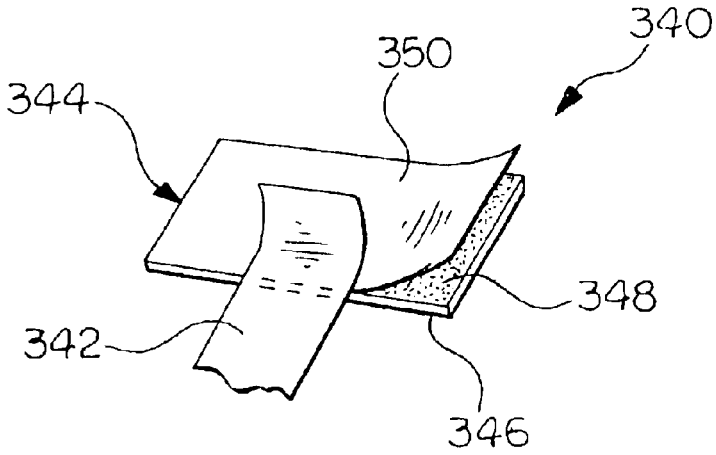
FIG. 16 is a fragmentary perspective view of a fastener for use with the lower garment in accordance with the present invention.

There is shown in FIG. 16 a fastener 340 for use with the patient examination garment according to the present invention. The fastener 340 includes a tab 342 that is attached an outwardly facing surface of a movable portion of a garment, such as the rear central panel 330 of the rear panel 304. The tab 340 is positioned such that a free end overlaps the fixed portion of the garment. The fastener 340 also includes a holder 344 that is attached to an outer surface of the rear panel 304 adjacent the free end of the tab 342. The holder 344 has a generally planar body 346 that is attached to the garment. The body 346 has an outwardly facing surface covered by a layer of adhesive material 348. A cover sheet 350 is releasably attached to the base member 346 to prevent contact between the tab 342 and the adhesive material layer 348. After the movable portion of the garment has been used, the cover sheet 350 can be removed and the tab 342 attached to the holder 346 by the adhesive material 348.

Figure 17:
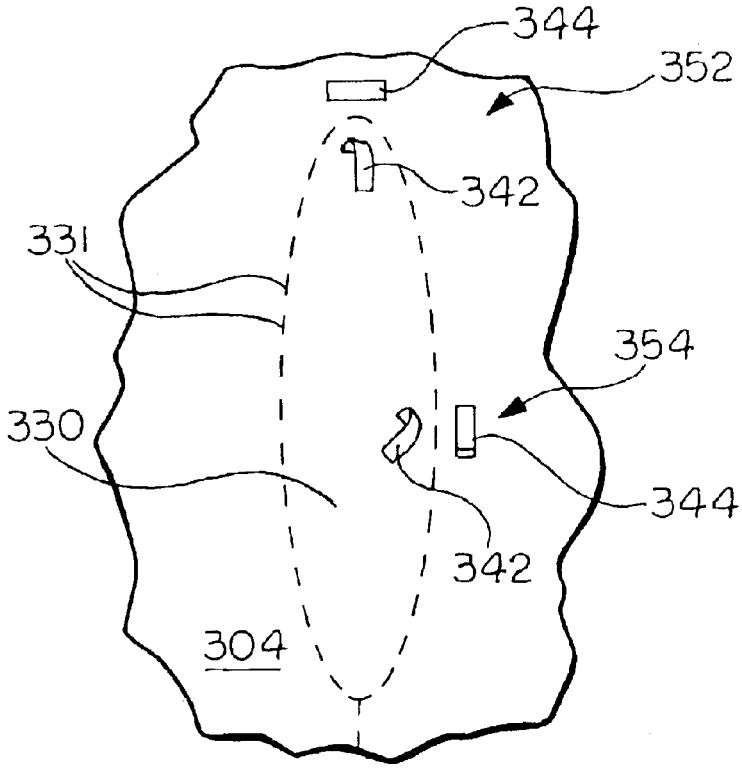
FIG. 17 is a fragmentary rear view of the lower garment shown in FIG. 14 utilizing the fastener shown in FIG. 16.

There is shown in FIG. 17 a portion of the rear panel 304 including the rear central panel 330. A first fastener 352, like the fastener 350 shown in FIG. 16, has the tab 342 attached to the outer surface of the rear central panel 330 at a top end thereof. The holder 344 of the first fastener 352 is attached to the outer surface of the rear panel 304 adjacent the tab 342. Thus, the rear central panel 330 can be partially detached at the perforations along the top and sides and reflected downwardly for examination purposes. After such use, the cover sheet can be removed from the holder 344, the rear central panel 330 moved back into the covering position shown, and the tab 342 attached to the holder 346 by the adhesive material. A second fastener 354, like the fastener 350 shown in FIG. 16, has the tab 342 attached to the outer surface of the rear central panel 330 at a side thereof. The holder 344 of the second fastener 354 is attached to the outer surface of the rear panel 304 adjacent the tab 342. Thus, the rear central panel 330 can be partially detached at the perforations along the top, bottom, the right side and part of the left side and reflected toward the left for examination purposes. After such use, the cover sheet can be removed from the holder 344, the rear central panel 330 moved back into the covering position shown, and the tab 342 attached to the holder 346 by the adhesive material.

The upper garment 10 and the lower garments 100, 200, and 300 can be formed from any desired materials, including a disposable material, a biodegradable material, or cloth. A patient can wear only one of the garments 10 or 100/200/300, or both, depending upon the extent of the examination. The locations and number of fasteners shown in the figures and described above are illustrative only and are not limiting.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An examination garment to be worn by a patient during a physical examination, the examination garment comprising:

a front panel having a first and a second leg member extending therefrom;

a partially detachable front central panel formed in said front panel, said front central panel adapted to reflect upwardly when partially detached from said front panel;

a rear panel attached to said front panel, said front panel and said rear panel being sized to cover a pelvic region of a patient;

a partially detachable rear central panel formed in said rear panel, said rear central panel adapted to reflect upwardly when partially detached from said rear panel, said rear panel having a plurality of perforations formed therein extending in a line from said rear central panel to a bottom edge of said rear panel for separation of said rear panel along said line; and a plurality of leg fasteners attached at bottom edges of said leg members whereby when the examination garment is worn about a pelvic region of a patient said leg fasteners cooperate to encircle legs of the patient with said leg members.

2. The examination garment according to claim 1 wherein said leg members extend slightly below a knee of the patient when the examination garment is worn about the pelvic region of the patient.

3. The examination garment according to claim 1 including a plurality of panel fasteners attached to said rear central panel and said rear panel for holding said rear central panel in closed and open positions.

4. The examination garment according to claim 3 wherein said panel fasteners include a tab attached to said rear central panel and a holder attached to said rear panel for releasably retaining said tab.

5. The examination garment according to claim 4 wherein said holder has an adhesive material for releasably retaining said tab.

6. An examination garment including an upper garment and a lower garment to be worn by a patient during a physical examination, the examination garment comprising:

an upper garment adapted to be worn on an upper body portion of a patient and having a rear opening permitting examination of the patient's spine; and a lower garment adapted to be worn about a pelvic region of the patient said lower garment including;

a front panel having a first and a second leg member extending therefrom at a bottom edge;

a partially detachable front central panel formed integral with said front panel, said front central panel extending between two spaced lines of perforations formed in said front panel extending from said bottom edge, said front central panel adapted to reflect upwardly when partially detached from said front panel at said perforations;

a rear panel attached to said front panel, said front panel and said rear panel being sized to cover the pelvic region of the patient;

a partially detachable rear central panel formed in said rear panel, said rear central panel adapted to reflect upwardly when partially detached from said rear panel; and a plurality of leg fasteners attached at bottom edges of said leg members whereby when said lower garment is worn about the pelvic region of the patient said leg fasteners cooperate to encircle legs of the patient with said leg members.

7. The examination garment according to claim 6 wherein said leg members extend slightly below a knee of the patient when said lower garment is worn about the pelvic region of the patient.

8. An examination garment to be worn by a patient during a physical examination, the examination garment comprising:

a front panel having a first and a second leg member extending therefrom;

movable front central panel formed in said front panel, said front panel extending between two spaced lines of perforations formed in said front panel and downwardly to a bottom seam of said front panel, said front central panel adapted to reflect upwardly away from said leg members;

a rear panel attached to said front panel, said front panel and said rear panel being sized to cover a pelvic region of a patient;

a movable rear central panel being a portion of said rear panel partially separable from said rear panel at a plurality of perforations formed in said rear panel; and a plurality of panel fasteners attached to said rear panel and said rear central panel whereby when the examination garment is worn about a pelvic region of a patient said panel fasteners cooperate to selectively retain said rear central panel in open and closed positions.

9. The examination garment according to claim 8 wherein said leg members extend slightly below a knee of the patient when the examination garment is worn about the pelvic region of the patient.

10. The examination garment according to claim 8 wherein said panel fasteners permit said rear central panel to be reflected upwardly from the closed position to the open position.

11. The examination garment according to claim 8 wherein said panel fasteners permit said rear central panel to be reflected downwardly from the closed position to the open position.

* * * * *